US008350878B2

(12) United States Patent
Taguchi et al.

(10) Patent No.: US 8,350,878 B2
(45) Date of Patent: Jan. 8, 2013

(54) IMAGE ERASING APPARATUS, AND METHOD OF DETERMINING FOREIGN MATTER ATTACHED TO RECORDING MEDIUM SUPPLIED TO IMAGE ERASING APPARATUS

(75) Inventors: Hiroyuki Taguchi, Shizuoka-ken (JP); Isao Yahata, Shizuoka-ken (JP); Ken Iguchi, Shizuoka-ken (JP); Takahiro Kawaguchi, Shizuoka-ken (JP); Hiroyuki Tsuchihashi, Shizuoka-ken (JP); Hiroyuki Taki, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 121 days.

(21) Appl. No.: 13/042,435

(22) Filed: Mar. 7, 2011

(65) Prior Publication Data

US 2011/0234736 A1 Sep. 29, 2011

Related U.S. Application Data

(60) Provisional application No. 61/318,730, filed on Mar. 29, 2010.

(51) Int. Cl.
*B41J 29/16* (2006.01)

(52) U.S. Cl. ..... 347/179

(58) Field of Classification Search ..... 347/179, 347/171, 223, 104, 105, 120.01; 399/4, 186; 250/316.1, 317.1
See application file for complete search history.

(56) References Cited

U.S. PATENT DOCUMENTS 5,683,189 A * 11/1997 Sukigara et al. ..... 347/179
6,152,620 A * 11/2000 Ozawa et al. ..... 347/179
6,860,658 B2 * 3/2005 Tischer ..... 347/171
7,324,237 B2 * 1/2008 Okada ..... 347/179

* cited by examiner

*Primary Examiner* — Kristal Feggins
(74) *Attorney, Agent, or Firm* — Patterson & Sheridan, LLP

(57) ABSTRACT

An image erasing apparatus includes: a supply unit that supplies a recording medium; a recovery unit that recovers the recording medium supplied by the supply unit; a plurality of pairs of carrying rollers that carry the recording medium supplied by the supply unit toward the recovery unit; a detecting unit that acquires information regarding foreign matter made of metal attached to the recording medium; a heating unit that heats the recording medium to a temperature equal to or higher than a color-erasing temperature of a developer; and a carriage control unit that reduces a rotation speed of the plurality of pairs of rollers from a first speed to a second speed when the detecting unit acquires the information regarding the foreign matter made of metal.

19 Claims, 4 Drawing Sheets

IMAGE ERASING APPARATUS, AND METHOD OF DETERMINING FOREIGN MATTER ATTACHED TO RECORDING MEDIUM SUPPLIED TO IMAGE ERASING APPARATUS

CROSS-REFERENCE TO RELATED APPLICATION

This application is also based upon and claims the benefit of priority from U.S. provisional application 61/318,730, filed on Mar. 29, 2010; the entire contents of which are incorporated herein by reference.

FIELD

Embodiments described herein relate generally to an image erasing apparatus that erases an image formed on a recording medium.

BACKGROUND

An image erasing apparatus according to a related art includes a large metal detection apparatus to detect staples or the like attached to a recording medium. Therefore, there is a problem in that the size and cost of the image erasing apparatus is increased. In addition, in order to solve this problem, a method of optically detecting staples instead of performing metal detection is known. However, the optical detecting method has a problem in that an image formed on a recording medium and a staple cannot be distinguished from one another.

DETAILED DESCRIPTION

An image erasing apparatus according to an embodiment includes: a supply unit that supplies a recording medium; a recovery unit that recovers the recording medium supplied by the supply unit; a carriage path on which the recording medium supplied by the supply unit is carried toward the recovery unit; a foreign matter information acquisition unit that includes a first conductive brush and a second conductive brush of which distal portions respectively come in contact with an upper surface and a lower surface of the recording medium carried on the carriage path; and a heating unit that heats the recording medium at a temperature equal to or higher than a color-erasing temperature of a developer at an erasing position which is on a downstream side of a carriage direction of the carriage path than an acquisition position of the foreign matter information acquisition unit.

First Embodiment

Figure 1:
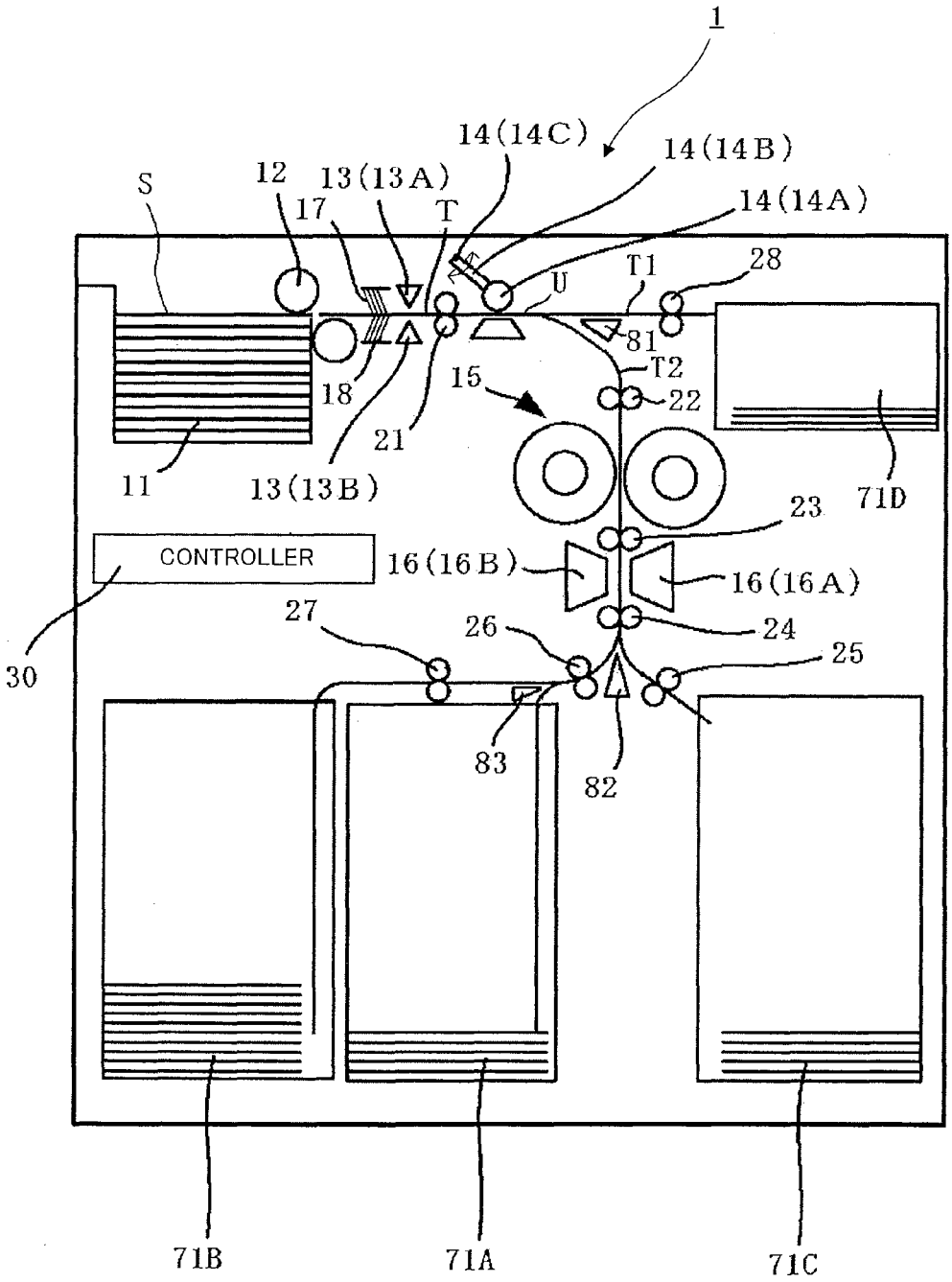
FIG. 1 is a cross-sectional view of an image erasing apparatus.

FIG. 1 is a cross-sectional view of an image erasing apparatus according to this embodiment, and the insides of partial elements needed for description are seen for illustration. An image erasing apparatus 1 according to this embodiment includes a paper feed tray 11, a pickup roller 12, a multiple-feed detection sensor 13, a media sensor 14, a heating device 15, a scanner 16, a first conductive brush 17, a second conductive brush 18, a plurality of pairs of rollers 21 to 28, and a controller 30.

The paper feed tray 11 stacks a number of recording media (sheets) S. On the recording medium S, an image is formed by a developer. The pickup roller 12 picks up the recording medium S stacked in the paper feed tray 11 so as to be supplied to a carriage path T of the recording medium. The picking-up operation of the pickup roller 12 is controlled by the controller 30. Here, while there is a case where the recording media S stacked in the paper feed tray 11 are picked up by the pickup roller 12 one by one, there is a case where a plurality of recording media S stacked are integrally picked up. The case where the plurality of recording media S are integrally picked up includes a state where the recording media S are bound by foreign matter made of metal such as staples or clips.

The multiple-feed detection sensor 13 detects a multiple-feed of the recording media S. The multiple-feed detection sensor 13 includes a transmission sensor 13A and a reception sensor 13B. The transmission sensor 13A outputs ultrasonic waves. The reception sensor 13B receives the ultrasonic waves output by the transmission sensor 13A. The ultrasonic waves are attenuated as they pass through the recording media S. The controller 30 determines presence of the multiple-feed on the basis of an output waveform of a signal output by the reception sensor 13B.

The media sensor 14 includes an abutting portion 14A and a swing bar 14B. One end of the swing bar 14B includes the abutting portion 14A, and the other end thereof includes a shaft portion 14C. The swing bar 14B swings in an arrow direction from the shaft portion 14C as a rotation shaft. When the plurality of recording media S in the multiple-feed state reaches a detection position of the media sensor 14, a rotation angle of the swing bar 14B is increased than that when only a single sheet of the recording medium S reaches. The controller 30 determines presence of the multiple-feed on the basis of the rotation angle of the swing bar 14B.

The carriage path T extends in the horizontal direction from a start point in the carriage direction and includes a first carriage path T1 further extending in the horizontal direction from a branched position U and a second carriage path T2 extending downward from the branched position U. A switching device 81 is positioned at the branched position U. The controller 30 controls driving of the switching device 81.

The heating device 15 is positioned on a downstream side of the carriage path T than the media sensor 14. The heating device 15 includes a first heating device 15A and a second heating device 15B. The first and second heating devices 15A and 15B are opposed to each other with the carriage path T interposed therebetween. The heating device 15 heats the recording medium S to a color-erasing temperature which is a temperature at which color of the developer disappears so as to erase the image formed on the recording medium S.

The scanner 16 is positioned on the downstream side of the carriage path T than the heating device 15. The scanner 16 includes a first scanner 16A and a second scanner 16B. The first scanner 16A and the second scanner 16B are opposed to each other with the carriage path T interposed therebetween. The controller 30 determines whether or not erasure of the image of the recording medium S is successful on the basis of an output of the scanner 16.

The image erasing apparatus 1 includes stacking devices 71A, 71B, 71C, and 71D. The stacking device 71D is positioned at an end point of the first carriage path T1. The recording media S from which a staple is detected are stacked in the stacking device 71D. The stacking devices 71A, 71B, and 71C are positioned at an end point of the second carriage path T2. The recording medium heated by the heating device 15 is stacked in any of the stacking devices 71A, 71B, and 71C. Specifically, the controller 30 operates a switching device 82 so that the recording media S for which image erasure is not successful are stacked in the stacking device 71C. The controller 30 operates a switching device 83 so that the recording media S for which image erasure is successful are sorted depending on recording medium sizes so as to be stacked in the stacking device 71A or 71B.

The first pair of rollers 21 are positioned between the multiple-feed detection sensor 13 and the media sensor 14 and rotate while pinching the recording medium S passing through the multiple-feed detection sensor 13 so as to carry the recording medium S toward the media sensor 14. The second pair of rollers 22 are positioned between the media sensor 14 and the heating device 15 on the second carriage path T2 and rotate while pinching the recording medium S passing through the media sensor 14 so as to carry the recording medium S toward the heating device 15.

The third pair of rollers 23 are positioned between the heating device 15 and the scanner 16 on the second carriage path T2 and rotate while pinching the recording medium S passing through the heating device 15 so as to carry the recording medium S toward the fourth pair of rollers 24. The fourth pair of rollers 24 are positioned on the second carriage path T2 and carry the recording medium S passing through the scanner 16 toward any of the stacking devices 71A, 71B, and 71C.

The fifth pair of rollers 25 are positioned on the second carriage path T2 and carry the recording medium S carried from the fourth pair of rollers 24 to the stacking device 71C. The sixth pair of rollers 26 are positioned on the second carriage path T2 and carry the recording medium S carried from the fourth pair of rollers 24 to the stacking device 71A. The seventh pair of rollers 27 are positioned on the second carriage path T2 and carry the recording medium S carried from the fourth pair of rollers 24 to the stacking device 71B.

The eighth pair of rollers 28 are positioned on the first carriage path T1 and rotate while pinching the recording medium S so as to carry the recording medium S to the stacking device 71D.

The first and second conductive brushes 17 and 18 are positioned on an upstream side of the carriage path T than the multiple-feed detection sensor 13. The first conductive brush 17 comes in contact with an upper surface of the recording medium S supplied to the carriage path T. The second conductive brush 18 comes in contact with a lower surface of the recording medium S supplied to the carriage path T. The first conductive brush 17 is formed in a linear shape in which a distal portion is positioned on the downstream side of the carriage direction of the carriage path T than a proximal portion. The second conductive brush 18 is formed in a linear shape in which the distal portion is positioned on the downstream side of the carriage direction of the carriage path T than the proximal portion. Accordingly, contact areas of the first and second conductive brushes 17 and 18 being in contact with the recording media S are increased, so that detection precision is increased and carriage resistance is reduced.

The first and second conductive brushes 17 and 18 are positioned on the carriage path T while not being in contact with each other. Since they are not in contact with each other, a potential is changed when they come in contact with the staple attached to the recording medium S.

The first and second conductive brushes 17 and 18 may also be neutralization brushes.

The controller 30 performs various kinds of control executed by the image erasing apparatus 1. The controller 30 may be a CPU or an MPU. The controller 30 may also be an ASIC circuit that executes at least a part of processing realized by the CPU or the MPU on the circuit. The number of CPUs, MPUs, or ASIC circuits is not limited. Depending on the contents of control, different CPUs may be used for the control. In addition, the controller 30 may include other elements needed for the control.

Figure 2:
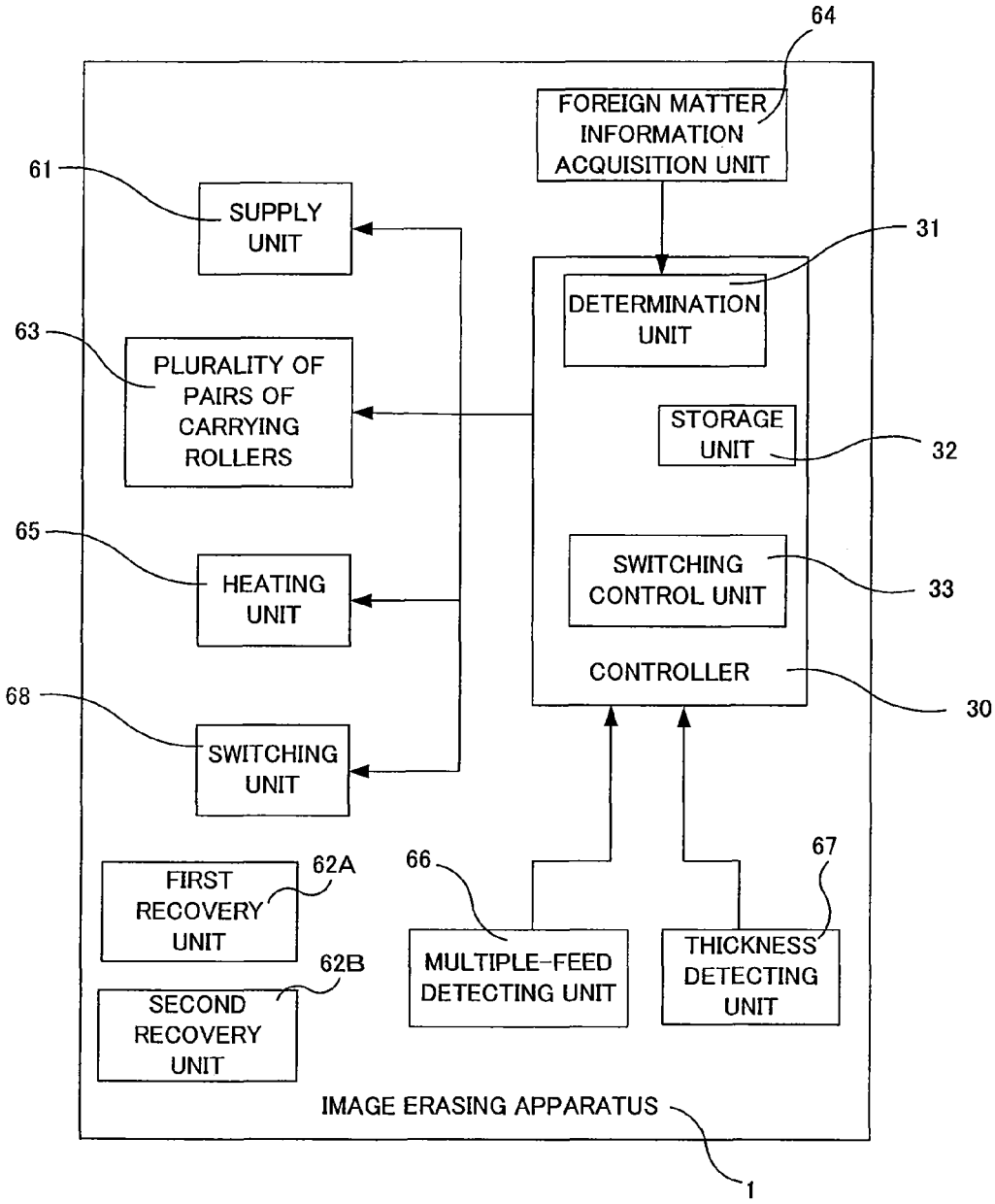
FIG. 2 is a function block diagram of the image erasing apparatus.

Next, an example of the configuration for realizing this embodiment is shown by a block diagram of FIG. 2. The image erasing apparatus 1 includes a supply unit 61, a first recovery unit 62A, a second recovery unit 62B, a plurality of pairs of carrying rollers 63, a foreign matter information acquisition unit 64, a heating unit 65, a multiple-feed detecting unit 66, and a thickness detecting unit 67.

The supply unit 61 supplies the recording medium S to the carriage path T of the image erasing apparatus 1. Referring to FIGS. 1 and 2, the supply unit 61 may be realized by the paper feed tray 11, the pickup roller 12, and a motor that drives the pickup roller 12 in cooperation with each other.

The first recovery unit 62A recovers the recording medium S from which foreign matter information is acquired by the foreign matter information acquisition unit 64. Referring to FIGS. 1 and 2, the first recovery unit 62A may be the stacking device 71D. The second recovery unit 62B recovers the recording medium S from which foreign matter information is not acquired by the foreign matter information acquisition unit 64. The second recovery unit 62B may be the stacking devices 71A, 72B, and 71C. The number of stacking devices is not limited to that according to the embodiment of FIG. 1 and for example, may be 1.

Referring to FIGS. 1 and 2, the plurality of pairs of carrying rollers 63 may be the plurality of pairs of rollers 21 to 28. The number of the plurality of pairs of carrying rollers 63 is not limited to that according to the embodiment of FIG. 1.

The foreign matter information acquisition unit 64 acquires information regarding foreign matter made of metal attached to the recording medium S. The foreign matter made of metal may be a binding member used for binding a plurality of overlapped recording media S. The binding member may be a staple or a clip. The foreign matter information acquisition unit 64 outputs a detection result to the controller 30.

Figure 3:
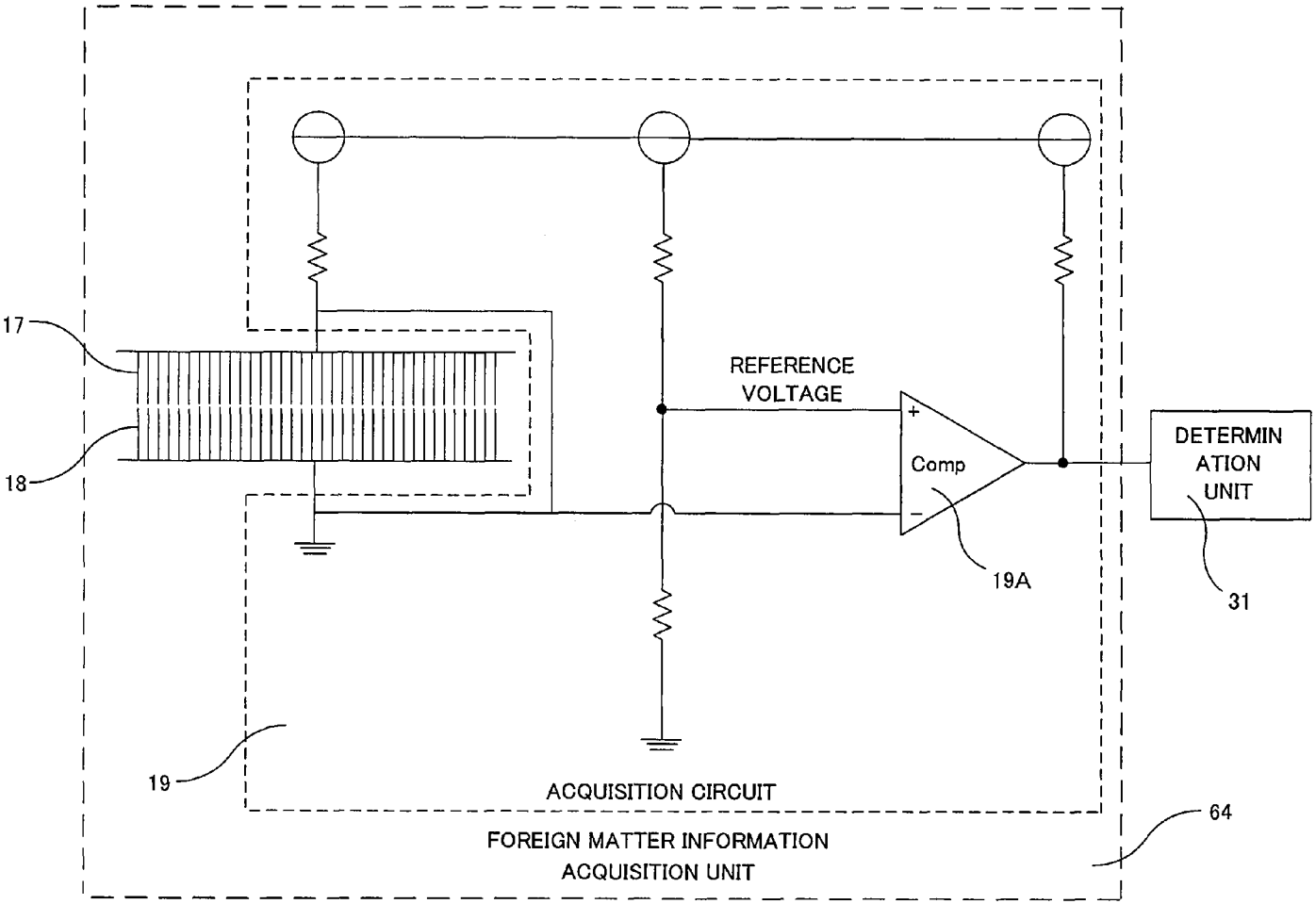
FIG. 3 is a schematic diagram of a foreign matter information acquisition unit.

FIG. 3 is a schematic diagram of the configuration of the foreign matter information acquisition unit 64. Referring to FIG. 3, the foreign matter information acquisition unit 64 includes the first and second conductive brushes 17 and 18 and an acquisition circuit 19. When multiple-feed sheets formed by binding a plurality of overlapped sheets with a staple (foreign matter) made of metal are supplied to the carriage path T as the recording media S, the first and second conductive brushes 17 and 18 are electrically connected via the staple. FIG. 3 is a schematic diagram of the first and second conductive brushes 17 and 18 as viewed in the carriage direction of the carriage path T, and a number of bristles of each brush are lined up in the horizontal direction. Accordingly, the first and second conductive brushes 17 and 18 come in contact with the entire recording media S and thus acquire information regarding foreign matter more reliably.

The acquisition circuit 19 includes a comparator 19A. The comparator 19A changes an output signal between a first state in which the first and second conductive brushes 17 and 18 are electrically connected to each other via the staple, and a second state in which the first and second conductive brushes are not electrically connected to each other via the staple. That is, in the second state (a state without foreign matter), the comparator 19A outputs an H (High) signal, and in the first state (a state with foreign matter), the comparator 19A outputs an L (Low) signal. A determination unit 31 receives the signal output by the comparator 19A and determines presence or absence of foreign matter. The determination unit 31 may be the controller 30.

Returning to FIG. 2, the image erasing apparatus 1 is described. The heating unit 65 is positioned on the downstream side than the acquisition position of the foreign matter information acquisition unit 64, and at the erasure position on the second carriage path T2, heats the recording medium S to a temperature equal to or higher than the color-erasing temperature of the developer. The controller 30 controls operations of the heating unit 65. Referring to FIGS. 1 and 2, the heating unit 65 may be the heating device 15. The multiple-feed detecting unit 66 detects the multiple-feed of the recording media S. Referring to FIGS. 1 and 2, the multiple-feed detecting unit 66 may be the multiple-feed detection sensor 13. The thickness detecting unit 67 detects the thickness of the recording medium S. The thickness detecting unit 67 may be the media sensor 14.

A switching unit 68 switches the carriage path T between the first carriage path T1 and the second carriage path T2 at the branched position U of FIG. 1. Referring to FIGS. 1 and 2, the switching unit 68 may be the switching device 81.

A storage unit 32 stores programs for performing various kinds of control of the image erasing apparatus 1. The storage unit 32 may be an HDD or a memory. The controller 30 reads out the programs stored in the HDD on the memory. The storage unit 32 may be positioned outside the controller 30.

Figure 4:
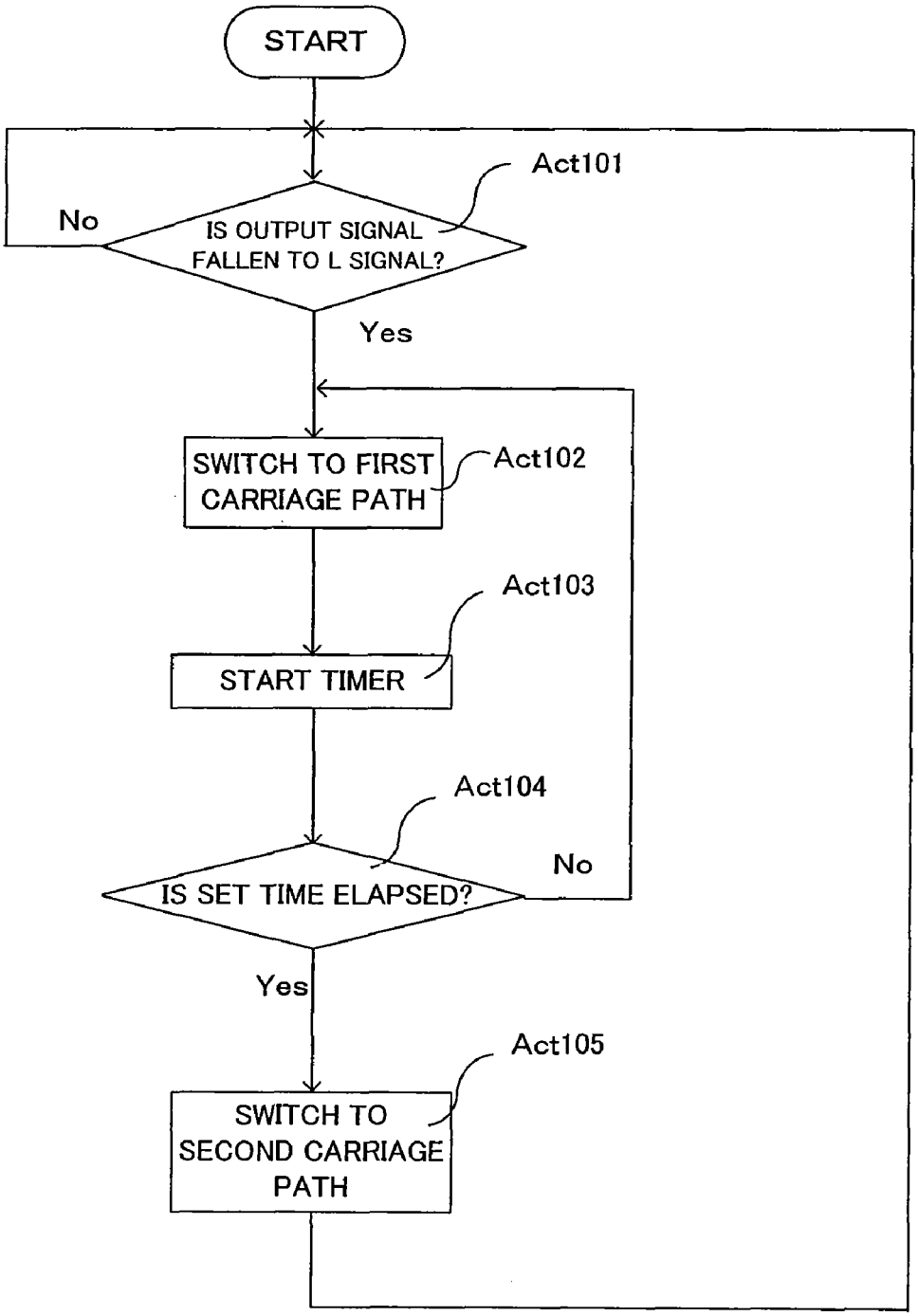
FIG. 4 is a flowchart showing operations of the image erasing apparatus.

Next, operations of the image erasing apparatus 1 will be described with reference to a flowchart of FIG. 4. At an initial state, the first and second conductive brushes 17 and 18 are not in contact with each other via the staple. In addition, the switching device 81 is set to guide the recording medium S to the second carriage path T2.

In Act 101, the controller 30 determines whether or not the signal output from the comparator 19A is the L signal fallen from the H signal. When the output signal of the comparator 19A is fallen to the L signal, in Act 102, the controller 30 drives the switching device 81 so as to switch the carriage path T from the second carriage path T2 to the first carriage path T1.

In Act 103, the controller 30 drives a timer (not shown) and then proceeds to Act 104. In Act 104, the controller 30 determines whether or not a set time elapses. Here, the set time corresponds to a time taken until the recording medium S passes through the branched position U from the foreign matter information acquisition position of the foreign matter information acquisition unit 64. Therefore, the recording medium S to which the staple is attached goes straight along the first carriage path T1 to be stacked in the stacking device 71D. Accordingly, the recording medium S to which the staple is attached is prevented from entering the second carriage path T2 and being bent. As a result, concurrence of jams is suppressed.

In Act 105, the controller 30 drives the switching device 81 such that the carriage path T is switched from the first carriage path to the second carriage path, and returns to Act 101.

While certain embodiments have been described, these embodiments have been presented by way of example only, and are not intended to limit the scope of invention. Indeed, the novel apparatus described herein may be embodied in a variety of other forms; furthermore, various omissions, substitutions and changes in the form of the apparatus described herein may be made without departing from the spirit of the inventions. The accompanying claims and their equivalents are intended to cover such forms or modifications as would fall within the scope and spirit of the inventions.

What is claimed is:

1. An image erasing apparatus comprising:

a supply unit that supplies a recording medium;

a recovery unit that recovers the recording medium supplied by the supply unit;

a carriage path on which the recording medium supplied by the supply unit is carried toward the recovery unit;

a foreign matter information acquisition unit that includes a first conductive brush and a second conductive brush of which distal portions respectively come in contact with an upper surface and a lower surface of the recording medium carried on the carriage path; and a heating unit that heats the recording medium at a temperature equal to or higher than a color-erasing temperature of a developer at an erasing position which is on a downstream side of a carriage direction of the carriage path than an acquisition position of the foreign matter information acquisition unit.

2. The apparatus according to claim 1, wherein the first and second conductive brushes are positioned on the carriage path while not being in contact with each other.

3. The apparatus according to claim 1, wherein, when multiple-feed sheets made by binding a plurality of stacked sheets using a binding member made of metal are supplied to the carriage path as the recording medium, the first and second conductive brushes are electrically connected to each other via the binding member.

4. The apparatus according to claim 3, wherein the foreign matter information acquisition unit includes an acquisition circuit that connects the first and second conductive brushes to each other, and the acquisition circuit includes a comparator that changes an output signal between a first state in which the first and second conductive brushes are electrically connected to each other via the binding member, and a second state in which the first and second conductive brushes are not electrically connected to each other via the binding member.

5. The apparatus according to claim 4, further comprising a determination unit that determines presence or absence of the binding member on the basis of the signal output by the comparator.

6. The apparatus according to claim 1, wherein the first and second conductive brushes have a linear shape in which the distal portions thereof are positioned on the downstream side of the carriage direction of the carriage path than proximal portions thereof.

7. The apparatus according to claim 1, wherein, as viewed in the carriage direction of the carriage path, a number of the first conductive brushes are lined up in a horizontal direction, and a number of second conductive brushes are lined up in the horizontal direction.

8. The apparatus according to claim 1, wherein the recovery unit includes a first recovery unit that recovers the recording medium from which foreign matter information is acquired by the foreign matter information acquisition unit, and a second recovery unit that recovers the recording medium from which foreign matter information is not acquired, the carriage path includes a first carriage path on which the recording medium is carried to the first recovery unit, and a second carriage path on which the recording medium is carried to the second recovery unit, the first and second carriage paths being branched from the stream of the carriage path, a switching unit that switches the carriage direction of the recording medium between the first and second carriage paths at the branched position, and a switching control unit that controls the switching unit depending on an acquisition result of the foreign matter information acquisition unit.

9. The apparatus according to claim 8, wherein the first and second conductive brushes are positioned on an upstream side of the carriage direction of the carriage path than the switching unit.

10. The apparatus according to claim 9, wherein the erasing position is positioned on the second carriage path.

11. The apparatus according to claim 8, further comprising a multiple-feed detecting unit that detects a multiple-feed of the recording media at a detection position on the carriage path, wherein the first and second conductive brushes are positioned on an upstream side of the carriage direction than the detection position.

12. The apparatus according to claim 8, further comprising a thickness detecting unit that detects a thickness of the recording medium at a detection position on the carriage path, wherein the first and second conductive brushes are positioned on an upstream side of the carriage direction than the detection position.

13. A determination method comprising:

in an image erasing apparatus that erases a developer image formed on a sheet-like recording medium by carrying and heating the recording medium, on a carriage path of the recording medium, causing a first conductive brush and a second conductive brush to come in contact with foreign matter made of metal attached to the recording medium from an upper side and a lower side of the recording medium; and determining presence or absence of the foreign matter on the basis of a change in potential before and after the contact of an acquisition circuit that is connected to the first and second conductive brushes.

14. The method according to claim 13, wherein the first and second conductive brushes are positioned on the carriage path while not being in contact with each other.

15. The method according to claim 13, wherein the foreign matter is a binding member that binds a plurality of stacked sheets, and when multiple-feed sheets bound by the binding member are supplied to the carriage path as the recording medium, the first and second conductive brushes are electrically connected to each other via the binding member.

16. The method according to claim 13, wherein the first and second conductive brushes have a linear shape in which distal portions thereof are positioned on a downstream side of a carriage direction of the carriage path than proximal portions thereof.

17. The method according to claim 13, wherein, as viewed in a carriage direction of the carriage path, a number of the first conductive brushes are lined up in a horizontal direction, and a number of second conductive brushes are lined up in the horizontal direction.

18. The method according to claim 13, wherein the carriage path includes a first carriage path that recovers the recording medium without erasing the developer, and a second carriage path that is directed to an erasing position to erase the developer of the recording medium, and the recording medium from which the foreign matter is detected is supplied to the first carriage path, and the recording medium from which foreign matter is not detected is supplied to the second carriage path.

19. The method according to claim 18, wherein the carriage path is branched into the first carriage path and the second carriage path in the stream of the carriage path, and the first and second conductive brushes are disposed on an upstream side of a carriage direction than a branched position of the first and second carriage paths.

* * * * *